United States Patent [19]

Nishimori

[11] Patent Number: 4,911,368

[45] Date of Patent: Mar. 27, 1990

[54] GRINDER PUMP

[75] Inventor: Shinji Nishimori, Yokohama, Japan

[73] Assignee: Ebara Corporation, Tokyo, Japan

[21] Appl. No.: 326,660

[22] Filed: Mar. 21, 1989

[30] Foreign Application Priority Data

Mar. 25, 1988 [JP] Japan ..... 63-39312

[51] Int. Cl.[4] ..... B02C 23/36

[52] U.S. Cl. ..... 241/46 B; 241/46.08; 241/46.11

[58] Field of Search ..... 241/46 R, 46 B, 46.11, 241/46.17, 46.02, 46.06, 46.08

[56] References Cited

U.S. PATENT DOCUMENTS

| | | | |
|---|---|---|---|
| 4,076,179 | 2/1978 | Tsukube | 241/46.11 |
| 4,108,386 | 8/1978 | Conery et al. . | |
| 4,454,993 | 6/1984 | Shibata et al. . | |
| 4,640,666 | 7/1989 | Sodergard | 241/46.11 X |
| 4,697,746 | 10/1987 | Nishimori | 241/46.11 X |

FOREIGN PATENT DOCUMENTS

| | | | |
|---|---|---|---|
| 496504 | 4/1947 | Japan . | |
| 53-129371 | 11/1978 | Japan . | |
| 117038 | 4/1981 | Japan | 241/46.11 |
| 62-35910 | 9/1987 | Japan . | |
| 63-54151 | 10/1988 | Japan . | |

*Primary Examiner*—Timothy V. Eley

*Attorney, Agent, or Firm*—Oblon, Spivak, McClelland, Maier & Neustadt

[57] ABSTRACT

Disclosed is a grinder pump having a grinder disk fixedly provided around a suction port formed in a pump casing and a grinder impeller fixed by a clamping nut on a front end of a pump impeller shaft so as to rotate together with the pump impeller along the inner periphery of the grinder disk. A ring-shaped boss extends axially from the front surface of the grinder impeller and surrounds the clamping nut, and agitating blades are integrally formed on the front surface. The radially inner ends of the blades are united with the ring-shaped boss. It is possible to grind continuously and smoothly foreign matter sucked into the suction port without any fear of any foreign matter becoming entangled in the agitating blades of the grinder impeller or around the clamping nut.

7 Claims, 4 Drawing Sheets

GRINDER PUMP

BACKGROUND OF THE INVENTION:

1. Field of the Invention

The present invention relates to a grinder pump provided with a grinding mechanism designed to grind into pieces foreign matter sucked into the suction port of the pump.

2. Description of the Prior Art

FIG. 1 is a fragmentary view of a typical conventional grinder pump, which particularly shows the suction port and vicinity of the pump. As is shown in the figure, a grinder impeller 55 is attached through a clamping nut 52 to an external thread provided on the end portion of a motor shaft 51. The grinder impeller 55 has two agitating blades 56 which are integrally provided on the impeller in such a manner as to respectively project from two symmetrically located position. The reference numeral 53 in FIG. 1 denotes a ring-like grinder disk fixedly mounted to a pump casing 54 and the reference numeral 53a denotes a plurality of open holes formed along the inner peripheral surface of the grinder disk and spaced apart from each other.

If foreign matter A is sucked into the suction port by the action of the grinder impeller 55, which rotates together with the motor shaft 51, the foreign matter A that has been sucked in is ground into pieces by the rotation of the grinder impeller 55 and the agitating blades 56 relative to the edges of open holes **53*a* in the grinder disk 53, and the finely-ground foreign matter a flows into the pump (not shown) through the holes 53*a*** as denoted by arrow a.

The above-described prior art suffers, however, from the following problems. Since the clamping nut 52 and the agitating blades 56 of the grinder impeller 55 appreciably project from the forward-most surface of the grinder impeller 55, foreign substances A are likely to be entangled in the agitating blades 56 and around the clamping nut 52 to impede the grinding function.

In addition, as shown in FIGS. 2(*a*) and 2(*b*), in this type of grinder pump, a plurality of auxiliary cutters 59 are usually provided in spaced relationship along the outer peripheral portion of the grinder impeller 55 in order to enhance the grinding operation of the impeller. Each of these auxiliary cutters 59 is formed by simply providing a crevasse-shaped cut 60 at the outermost portion **55*a* of the grinder impeller 55 as shown in FIG. 2**(*a*), or by providing a projection 61 and crevasse-shaped cut 60 adjacent to each other at the outermost portion **55*a* of the grinder impeller 55, as shown in FIG. 2**(*b*). In such a grinder impeller, however, the rearmost point 57 of the crevasse-shaped cut 60 provided in the grinder impeller 55 such as to form the auxiliary cutter 59 falls short of the rearmost end 58 of the back surface of the grinder impeller 55. Therefore, there is an area E between the outer peripheral surface of the grinder impeller 55 and the inner peripheral surface of the grinder disk 53 where grinding of foreign matter cannot be effected.

SUMMARY OF THE INVENTION

In view of the above-described problems of the prior art, it is a primary object of the present invention to provide a grinder pump having a grinding mechanism which is capable of continuously and smoothly grinding foreign matter sucked into a suction port without any fear of foreign matter being entangled in the agitating blades of the grinder impeller or the clamping nut and without an ineffective area being left where grinding cannot be effected between the outer peripheral surface of the grinder impeller and the inner peripheral surface of the grinder disk.

To this end, the present invention provides a grinder pump having a grinder disk fixedly provided around a suction port formed in a pump casing and a grinder impeller fixed by a clamping nut on the front end of a pump impeller shaft so as to rotate together with the pump impeller along the inner periphery of the grinder disk, wherein the improvement comprises: a ring-shaped boss axially extending from the front surface of the grinder impeller and surrounding said clamping nut; and agitating blades integrally formed on the front surface of the grinder impeller, the radially inner ends of the blades uniting with the ring-shaped boss.

In one embodiment of the present invention, agitating blades extend axially as far as or slightly beyond the distal end of the ring-shaped boss.

Further, auxiliary cutters are provided on the front surface of the grinder impeller, each auxiliary cutter being defined by a cut extending to the outer peripheral surface of the grinder impeller in such a manner that the rearmost point of the cut is located axially rearward of the rearmost end of the back surface of the grinder impeller, and auxiliary blades are provided on the back surface of the grinder impeller at positions corresponding to each cut.

By virtue of the above-described arrangement, foreign substances which in the prior art arrangement are likely to become entangled in the clamping nut are prevented from approaching it by the ring-shaped boss.

Since the agitating blades are so disposed as to unite with the ring-shaped boss and extend as far as or just beyond the distal end of the boss to thereby divide the outer periphery of the ring-shaped boss into two isolated portions separated by the agitating blades, no swirl will occur around the ring-shaped boss. There is therefore no fear of foreign matter becoming entangled in the boss. In addition, the agitating action at the suction port is enhanced by the agitating blades, so that heavy foreign substances are repelled by them.

Since cuts are provided to form a plurality of cutting edges on the outer peripheral surface of the grinder impeller in such a manner that the rearmost point of each cut is located axially rearward of the rearmost end of the back surface of the grinder impeller, cutting edges are formed over the entire width or axial distance of the outer peripheral surface of the grinder impeller. Accordingly, the grinding efficiency is increased. In addition, since each cut is deep, the opening portion through which finely-ground foreign substances are discharged is larger than in a case where the cut is relatively shallow, as in the case of the prior art, so that it is possible to smoothly discharge finely-ground foreign substances.

Further, if auxiliary blades are provided on the back surface of the grinder impeller at positions corresponding to the respective cuts, finely-ground foreign substances having passed through the opening can be immediately discharged by the action of the auxiliary blades.

BRIEF DESCRIPTION OF THE DRAWINGS:

The above and other objects, features and advantages of the present invention will become more apparent from the following description of the preferred embodiment thereof, taken in conjunction with the accompanying drawings, in which like reference numerals denote like elements and, of which:

FIG. 3(*b*) is a bottom view of the grinder pump shown in FIG. 3(*a*);

FIG. 4(*b*) is a side view of the grinder impeller;

FIG. 4(*c*) is a side view, of the portion B shown in FIG. 4(*a*);

FIG. 4(*d*) is a side view of the portion C shown in FIG. 4(*a*);

FIG. 4(*e*) is a side view of the portion D shown in FIG. 4(*a*);

DESCRIPTION OF THE PREFERRED EMBODIMENT:

One embodiment of the present invention will be described hereinunder in detail with reference to the accompanying drawings.

Figure 3A:
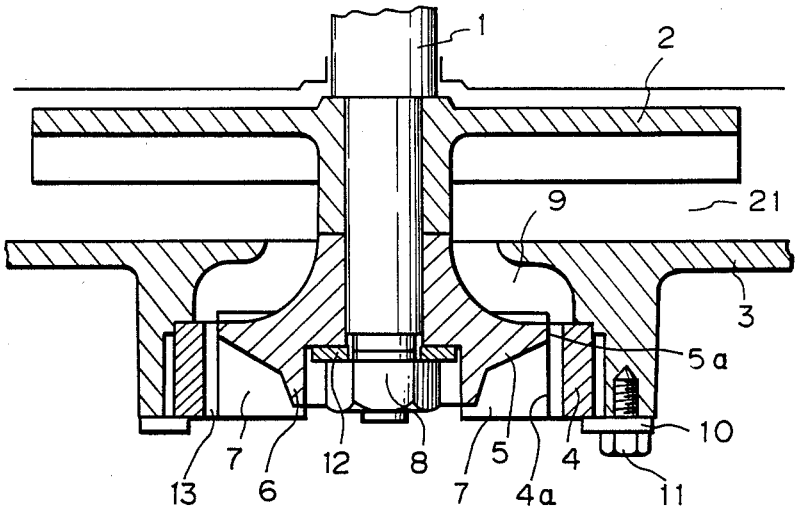
FIG. 3(*a*) is a fragmentary sectional view showing the structure of one embodiment of the grinder pump according to the present invention.
Figure 3B:
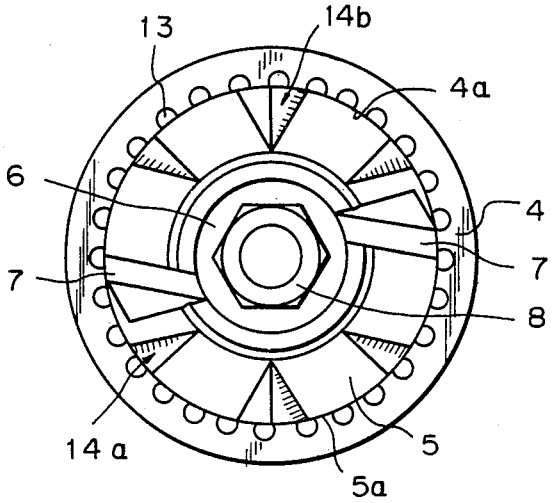
Figure 4A:
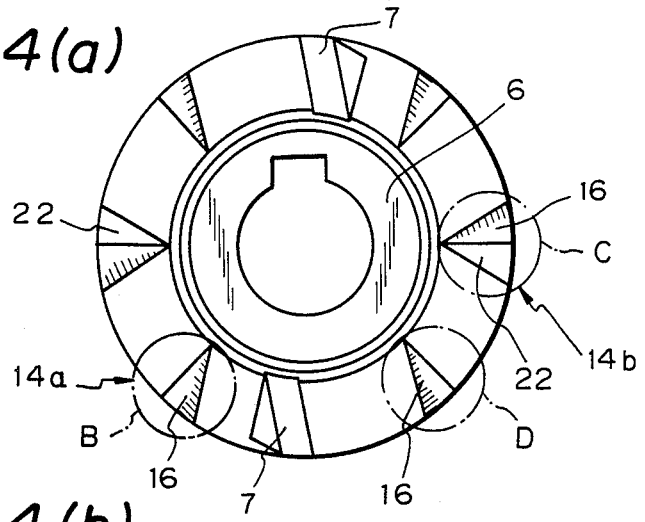
FIG. 4(*a*) is a plan view of the grinder impeller of the grinder pump according to the present invention.
Figure 4B:
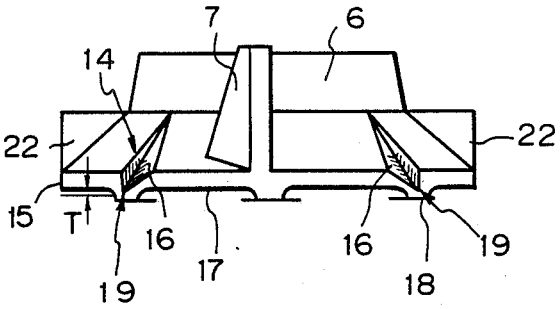
Figure 4C:
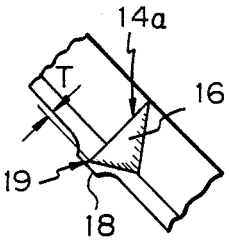
Figure 4D:
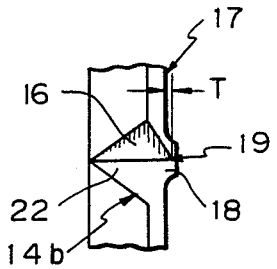
Figure 4E:
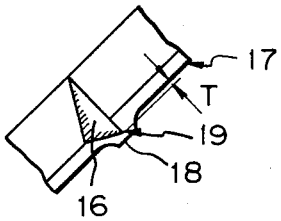

Referring to FIGS. 3 and 4, a pump impeller 2 and a grinder impeller 5 are fitted on a motor shaft 1 and secured thereto by means of a clamping nut 8 through a washer 12. A ring-like grinder disk 4 is clamped to the wall portion of a suction port 9 provided in a pump casing 3 by means of a retaining plate 10 which is secured by means of a bolt 11. The outer periphery 5*a* of the grinder impeller 5 faces the inner periphery 4*a* of the grinder disk 4 across a narrow gap in such a manner that the opposing two peripheral surfaces almost contact each other.

The grinder impeller 5 has a ring-shaped boss 6 formed integrally with it. The boss 6 extends from the front surface of the grinder impeller 5 so as to surround the clamping nut 8. Agitating blades 7 extend from the front surface of the grinder impeller and radially inner ends thereof are united with the outer peripheral portion of the ring-shaped boss 6. The outer peripheral portion of each agitating blade 7 also faces the inner periphery 4*a* of the grinder disk 4 across a narrow gap and is so disposed as to almost contact it.

A plurality of auxiliary cutters 14 are provided on the front surface of the grinder impeller 5. These auxiliary cutters include two kind of cutters 14*a* and 14*b*. The auxiliary cutter 14*a* is formed by simply providing a crevasse-shaped cut 16 on the front surface of the grinder impeller 5 in such a manner that the cut 16 extends as far as the outer peripheral end face 5*a* of the grinder impeller 5. On the other hand, the auxiliary cutter 14*b* is formed by providing a triangular-shaped projection 22 and a crevasse-shaped cut 16 such that they are adjacent to each other. The rearmost point 19 (bottommost point in FIG. 4) of each cut 16 is located axially rearward of the rearmost end 17 of the back surface of the grinder impeller 5 by a distance T.

Further, auxiliary blades 18 are provided on the back surface of the grinder impeller 5 at positions corresponding to the respective cuts 16.

Figure 5A:
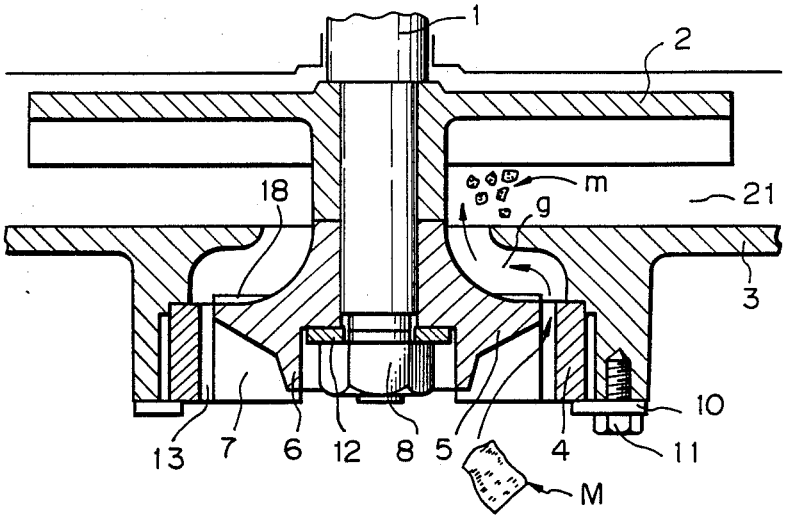
FIGS. 5(*a*) and 5(*b*) are similar to FIGS. 3(*a*) and 3(*b*) respectively, but show the operation of the grinder pump.
Figure 5B:
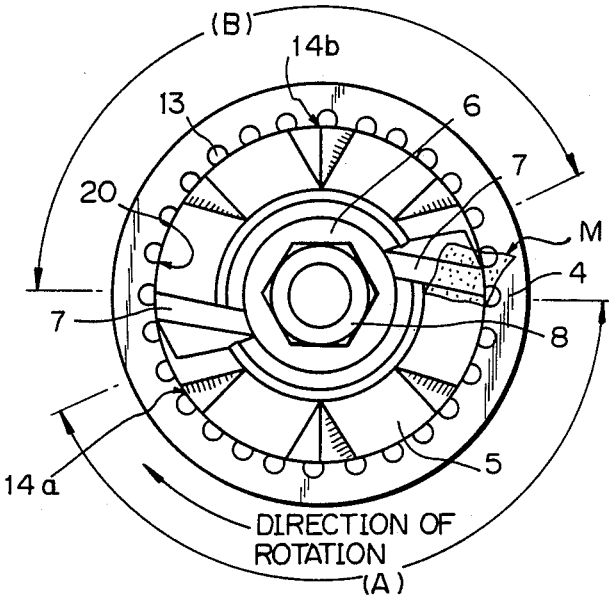

The operation of the grinder pump having the above-described arrangement will next be explained with reference to FIG. 5. In operation, the pump impeller 2 and the grinder impeller 5 rotate coaxially. If a foreign substance M is sucked in, it is ground into fine pieces of the foreign substance m in the gap between the grinder impeller 5 and the grinder disk 4 and with the cooperation between agitating blades 7 and the auxiliary cutters 14 and the edges 20 defined by the open holes 13 in the grinder disk 4. The finely-ground pieces of foreign substance m flow into the inside 21 of the pump through the holes 13 in the grinder disk 4 as indicated by arrows. In this case, foreign substance which would normally be likely to become entangled in the clamping nut 8 are prevented from approaching it by the ring-shaped boss 6. Further, since the agitating blades 7 are so disposed as to unite with the ring-shaped boss 6 to thereby divide the outer periphery of the ring-shaped boss 6 into two isolated portions (A) and (B), as shown in FIG. 5(b), no swirl is caused around the ring-shaped boss 6 and there is therefore no fear of foreign matter becoming entangled around the boss 6. Since the agitating blades 7 extend as far as or just beyond the distal end of the boss 6, satisfactory suction and agitation functions are made available and hard foreign substances such as metallic substances and stones can be repelled by the agitating blades 7.

Figure 1:
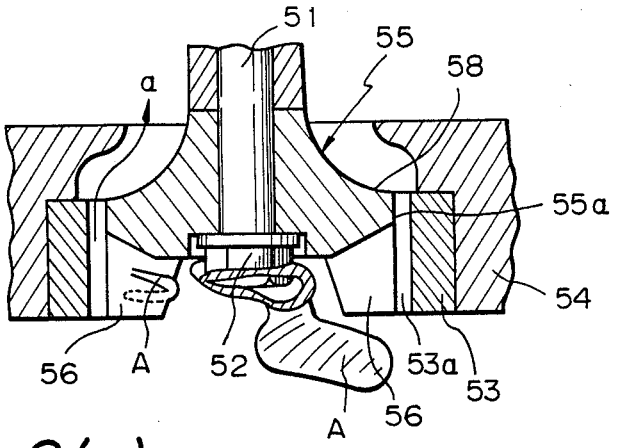
Fig. 1 PRIOR ART
FIG. 1 is a fragmentary view of a conventional grinder pump, which particularly shows the suction port and the vicinity of the pump.
Figure 2A:
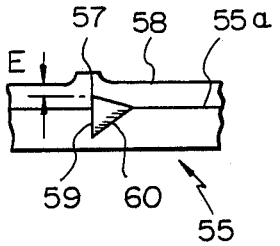
Fig. 2(a) PRIOR ART
FIGS. 2(*a*) and 2(*b*) are side views of the portion of the grinder impeller shown in FIG. 1 and each show the configuration of a crevasse-shaped cut provided in the outer peripheral surface of the grinder impeller of the prior art to form an auxiliary cutter.
Figure 2B:
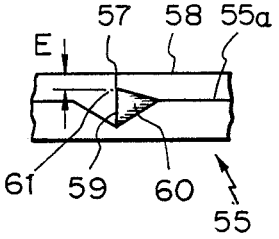
Fig. 2(b) PRIOR ART

In the conventional grinder pump, the rearmost point 57 of a crevasse-shaped cut 60 which is provided in the outer peripheral surface of the grinder impeller 55 to form an auxiliary cutter 59 falls short of the rearmost end 58 of the back surface of the grinder impeller 55, as described above [see FIGS. 2(*a*) and 2(*b*)]. Thus the prior art suffers from the problem that there is an ineffective area E between the outer peripheral surface of the grinder impeller 55 and the inner peripheral surface of the grinder disk 53 where grinding of foreign matter cannot be effected and this ineffective area E may become clogged with foreign matter. In contrast, in this embodiment the cuts 16 are provided to form a plurality of cutting edges on the outer peripheral surface 15 of the grinder impeller 5 in such a manner that the rearmost point 19 of each cut 16 is located axially rearward of the rearmost end 17 of the back surface of the grinder impeller 5, as shown in FIG. 4. Thus, cutting edges are formed over the entire width or axial length of the outer peripheral surface 15 of the grinder impeller 5 and, therefore, the grinding efficiency is increased.

Figure 6:
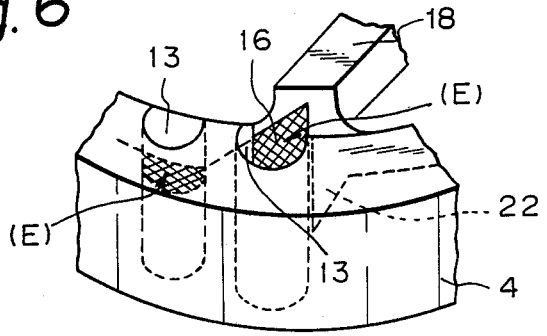
FIG. 6 shows the relationship between the cuts in the grinder impeller and the holes in the grinder disk according to the present invention.

FIG. 6 shows the relationship between the cuts 16 and the holes 13 in the grinder disk 4 in this embodiment. As is clear from the illustration, since in this embodiment each cut 16 is deep, the opening portion (E) through which finely-ground pieces of foreign substance m are discharged is larger than in the case where the cut 16 is relatively shallow, so that it is possible to smoothly discharge finely-ground foreign substance m. Further, since an auxiliary blade 18 is provided on the back surface of the grinder impeller 5 at a position corresponding to each cut 16, finely-ground pieces of the foreign substance m that have passed through the opening (E) can be immediately discharged by the action of the auxiliary blade 18 without any fear of clogging.

Thus, it is possible according to the present invention to provide a grinder pump having a grinding mechanism which is capable of continuously and smoothly grinding foreign matter sucked into the suction port without any fear of foreign matter becoming entangled in the agitating blades of the grinder impeller or around the clamping nut and without the presence of an ineffective area between the outer peripheral surface of the grinder impeller and the inner peripheral surface of the grinder disk where grinding of foreign matter cannot be effected.

Although the present invention has been described through specific terms, it should be noted here that the embodiment described is not necessarily exclusive and the various changes and modifications may be imparted thereto without departing from the scope of the invention which is limited solely by the appended claims.

What is claimed is:

1. A grinder pump having a grinder disk fixedly provided around a suction port formed in a pump casing and a grinder impeller fixed by a clamping nut on a front end of a pump impeller shaft in a direction of flow of pump fluid so as to rotate together with the pump impeller along an inner periphery of the grinder disk, comprising:

a ring-shaped boss axially extending from a front surface of said grinder impeller and surrounding said clamping nut; and agitating blades integrally formed on the front surface of said grinder impeller with radially inner ends of each of said agitating blades being united with an outer peripheral portion of said ring-shaped boss.

2. A grinder pump according to claim 1, wherein said agitating blades extends axially as far as or slightly beyond a distal end of said ring-shaped boss.

3. A grinder pump according to claim 1 or 2, wherein said agitating blades are so disposed on the front surface of said grinder impeller that said agitating blades divide the outer periphery of said ring shaped boss into two isolated portions.

4. A grinder pump according to claim 3, wherein a plurality of auxiliary cutters are provided on the front surface of said grinder impeller, each of said auxiliary cutters being defined by a cut extending to the outer peripheral surface of said grinder impeller in such a manner that the rearmost point of said cut is located axially rearward of the rearmost end of the back surface of said grinder impeller, and an auxiliary blade for said grinder impeller is provided on the back surface of said grinder impeller at a position corresponding to said cut.

5. A grinder pump according to claim 4, wherein said plurality of auxiliary cutters include two kinds of cutters, one of which is formed by providing a crevasse-shaped cut on the front surface of said grinder impeller, and the other of which is formed by providing a triangular-shaped projection and said crevasse-shaped cut on the front surface of said grinder impeller so that said projection and cut are adjacent to each other.

6. A grinder pump according to claim 1, wherein a plurality of auxiliary cutters are provided on the front surface of said grinder impeller, each of said auxiliary cutters being defined by a cut extending to the outer peripheral surface of said grinder impeller in such a manner that the rearmost point of said cut is located axially rearward of the rearmost end of the back surface of said grinder impeller, and an auxiliary blade for said grinder impeller is provided on the back surface of said grinder impeller at a position corresponding to said cut.

7. A grinder pump according to claim 1, wherein said grinder impeller has grinding edges which are separated from the inner periphery of said grinder disk by an axial gap extending in an axial direction.

* * * * *